US008730115B2

(12) United States Patent
Yeshanov et al.

(10) Patent No.: US 8,730,115 B2
(45) Date of Patent: May 20, 2014

(54) SYSTEM AND METHOD FOR ANTENNA POINTING CONTROLLER CALIBRATION

(71) Applicant: ViaSat, Inc., Carlsbad, CA (US)

(72) Inventors: Alex Yeshanov, San Diego, CA (US); Donald Buchman, San Diego, CA (US); Ronald Tabor, San Diego, CA (US)

(73) Assignee: Viasat, Inc., Carlsbad, CA (US)

( * ) Notice: Subject to any disclaimer, the term of this patent is extended or adjusted under 35 U.S.C. 154(b) by 0 days.

(21) Appl. No.: 13/993,060

(22) PCT Filed: Nov. 21, 2012

(86) PCT No.: PCT/US2012/066351

§ 371 (c)(1), (2), (4) Date: Jun. 10, 2013

(87) PCT Pub. No.: WO2013/081940

PCT Pub. Date: Jun. 6, 2013

(65) Prior Publication Data

US 2014/0055310 A1 Feb. 27, 2014

Related U.S. Application Data

(60) Provisional application No. 61/564,781, filed on Nov. 29, 2011.

(51) Int. Cl.
*H01Q 3/00* (2006.01)

(52) U.S. Cl.
USPC ..... 343/760

(58) Field of Classification Search
CPC ..... H01Q 1/125; H01Q 3/08; H01Q 1/1257; H01Q 3/02; H01Q 3/04
USPC ..... 343/760, 753; 342/359, 354; 455/13.3
See application file for complete search history.

(56) References Cited

U.S. PATENT DOCUMENTS

| | | | | |
|---|---|---|---|---|
| 5,587,714 | A | 12/1996 | Chu et al. | |
| 5,809,457 | A * | 9/1998 | Yee et al. | 701/472 |
| 6,393,255 | B1 * | 5/2002 | Lane | 455/13.3 |
| 6,567,040 | B1 * | 5/2003 | Sevaston | 342/354 |
| 7,095,376 | B1 | 8/2006 | Timothy et al. | |
| 7,437,222 | B2 * | 10/2008 | Liu et al. | 701/3 |
| 7,663,542 | B1 * | 2/2010 | Goodzeit et al. | 342/359 |
| 2008/0068927 | A1 | 3/2008 | Pillon | |
| 2010/0188304 | A1 * | 7/2010 | Clymer et al. | 343/753 |

FOREIGN PATENT DOCUMENTS

| | | |
|---|---|---|
| JP | 07-122925 | 5/1995 |
| WO | 2011-053161 | 5/2011 |

* cited by examiner

*Primary Examiner* — Huedung Mancuso
(74) *Attorney, Agent, or Firm* — Kilpatrick Townsend & Stockton LLP

(57) ABSTRACT

A craft (e.g., an aircraft, a spacecraft, a watercraft, a vehicle such as an automotive vehicle or a rail vehicle, or any suitable mobile platform) may incorporate a first inertial measurement unit. A calibration unit incorporating a second inertial measurement unit may be mounted to the craft with a mount point. One or more first inertial measurements may be received from the first inertial measurement unit and the second inertial measurement unit. One or more antenna pointing controller calibration parameters may be determined based at least in part on the first inertial measurement(s) and the second inertial measurement(s). An antenna pointing controller may be configured with the determined calibration parameters and may control a steerable antenna subsystem mounted with the mount point utilizing the determined calibration parameters. The mount point may be keyed such that inertial measurements with the mounted calibration unit are applicable to the mounted steerable antenna subsystem.

26 Claims, 8 Drawing Sheets

SYSTEM AND METHOD FOR ANTENNA POINTING CONTROLLER CALIBRATION

CROSS-REFERENCE TO RELATED APPLICATIONS

This application is a U.S. National Phase Application under 35 U.S.C. §371 of International Application No. PCT/US2012/066351, filed on Nov. 21, 2012, which claims priority to U.S. Provisional Application No. 61/564,781, filed Nov. 29, 2011, titled "Keyed IRU Antenna Alignment and Offset Calibration," having Client Reference No. VS-0497-US, the contents of which are hereby incorporated in its entirety by reference.

TECHNICAL FIELD

This invention pertains generally to calibration and, more particularly, to calibration involving inertial measurement units.

BACKGROUND

Some antennas, such as satellite antennas, perform best when they are pointed at a communication partner. Even when such antennas are immobile, such pointing can involve a significant calibration procedure. The challenge can be greater when the antenna is attached to a mobile platform such as an aircraft. In many such communications-on-the-move (CoTM) scenarios, antennas are designed so that pointing with relatively high accuracy and precision are needed to achieve optimal performance. While such accuracy and precision are achievable, the process of calibrating the antenna's alignment and attitude can be complex and expensive, particularly when the process involves craft that could otherwise be earning revenue. Should the antenna need replacement or removal for maintenance, it may be necessary to repeat the calibration process.

Some conventional calibration procedures attempt to address such problems using laser-based alignment and pointing calibration. However, such approaches can be time consuming and expensive in and of themselves. Some conventional calibration procedures involve slow rotation of the mobile platform itself, for example, rotating an aircraft on an airport tarmac while performing complex alignment procedures. This quickly becomes impractical and expensive when the mobile platform becomes large (e.g., large passenger aircraft). In addition, such calibration procedures can require access to a live communication partner, for example, a transmitting satellite. However, this in turn requires that the communication partner be "in view", for example, it may require that the calibration process be performed out of doors during good weather. Still further, such calibration procedures may require that the target antenna, or a suitable substitute, is actually installed in an operational mode as well as various calibration signal measurement tools, all of which adds to cost, time and equipment requirements. Some conventional calibration procedures can proceed without the target antenna, but require relocation of critical aircraft components, which is problematic in its own right.

Embodiments of the invention are directed toward solving these and other problems individually and collectively.

SUMMARY

An efficient and effective system and method for antenna pointing controller calibration is provided. A craft (e.g., an aircraft, a spacecraft, a watercraft, a vehicle such as an automotive vehicle or a rail vehicle, or any suitable mobile platform) may incorporate a first inertial measurement unit. A calibration unit incorporating a second inertial measurement unit may be mounted to the craft with a mount point. One or more first inertial measurements may be received from the first inertial measurement unit. One or more second inertial measurements may be received from the second inertial measurement unit. One or more antenna pointing controller calibration parameters may be determined based at least in part on the first inertial measurement(s) and the second inertial measurement(s). An antenna pointing controller may be configured with the determined calibration parameters and may control a steerable antenna subsystem mounted with the mount point utilizing the determined calibration parameters. The mount point may be keyed such that inertial measurements with the mounted calibration unit are applicable to a mounted steerable antenna subsystem. A computing device may be configured to facilitate, including with a graphical user interface, the determination of the antenna pointing controller calibration parameters and/or the configuration of the antenna pointing controller.

The terms "invention," "the invention," "this invention" and "the present invention" used in this patent are intended to refer broadly to all of the subject matter of this patent and the patent claims below. Statements containing these terms should be understood not to limit the subject matter described herein or to limit the meaning or scope of the patent claims below. Embodiments of the invention covered by this patent are defined by the claims below, not this summary. This summary is a high-level overview of various aspects of the invention and introduces some of the concepts that are further described in the Detailed Description section below. This summary is not intended to identify key or essential features of the claimed subject matter, nor is it intended to be used in isolation to determine the scope of the claimed subject matter. The subject matter should be understood by reference to appropriate portions of the entire specification of this patent, any or all drawings and each claim.

BRIEF DESCRIPTION OF THE DRAWINGS

Illustrative embodiments of the present invention are described in detail below with reference to the following drawing figures.

Note that the same numbers are used throughout the disclosure and figures to reference like components and features.

DETAILED DESCRIPTION

Figure 1:
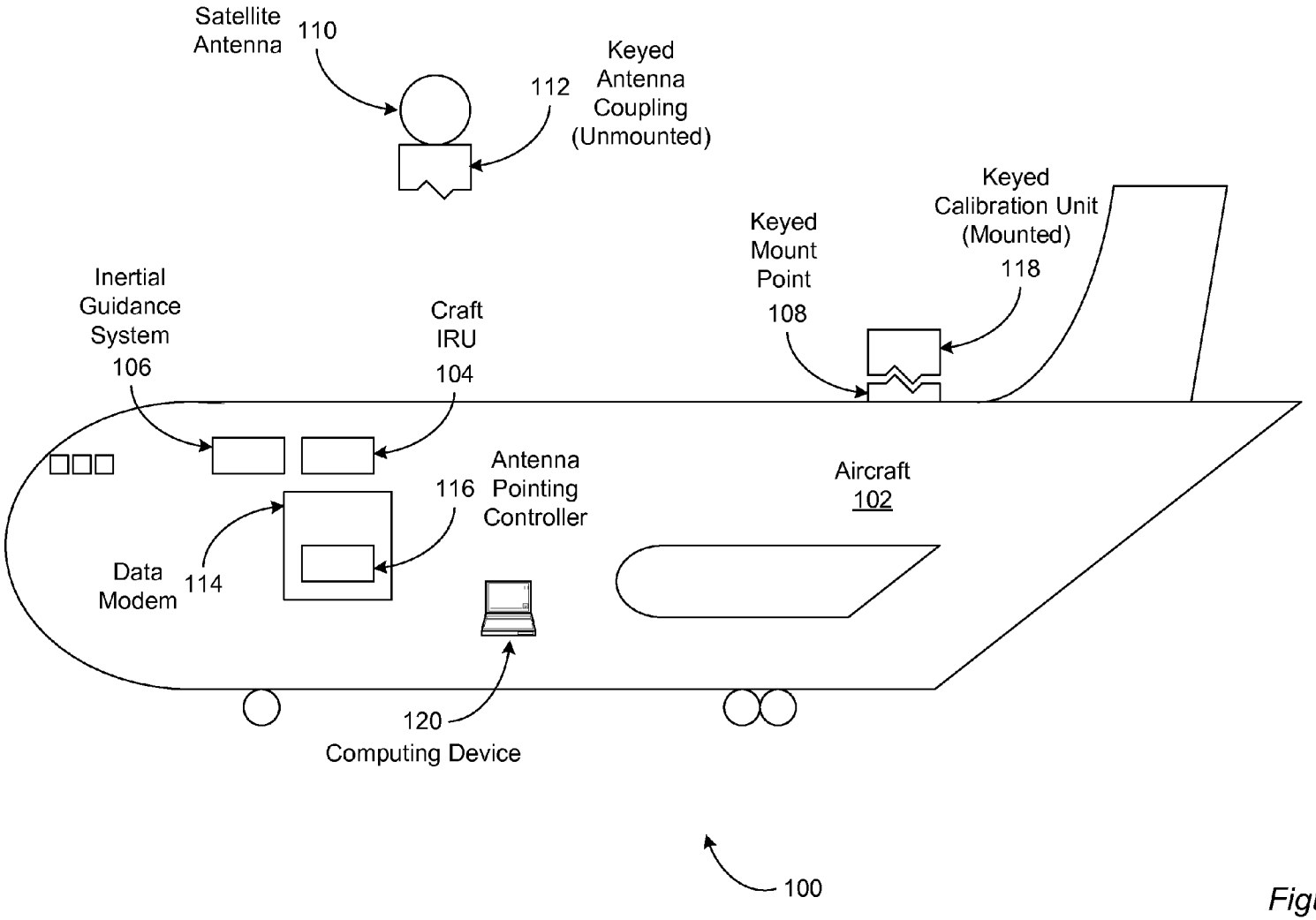
FIG. 1 is a schematic diagram depicting aspects of an example calibration environment in accordance with at least one embodiment of the invention.

The subject matter of embodiments of the present invention is described here with specificity to meet statutory requirements, but this description is not necessarily intended to limit the scope of the claims. The claimed subject matter may be embodied in other ways, may include different elements or steps, and may be used in conjunction with other existing or future technologies. This description should not be interpreted as implying any particular order or arrangement among or between various steps or elements except when the order of individual steps or arrangement of elements is explicitly described.

In accordance with at least one embodiment of the invention, efficient and effective systems and methods of antenna pointing controller calibration are provided. An antenna mount point on a craft (e.g., an aircraft, a spacecraft, a watercraft, a vehicle such as an automotive vehicle or a rail vehicle, or any suitable mobile platform) may be mechanically keyed such that mounted components (with correspondingly keyed couplings) may be mounted with a same unique alignment in accordance with the mechanical keying. Accordingly, a calibration unit with a suitably keyed coupling may be mounted on the craft with the keyed mount point. The calibration unit may include an inertial reference unit, IRU, inertial measurement unit or IMU (collectively, "inertial measurement unit"), and the inertial measurements obtained from the calibration unit (e.g., yaw, pitch and roll) may be applied to other components mounted with the keyed mount point. In particular, the inertial measurements with the mounted calibration unit may be applied to a mounted antenna (e.g., a satellite antenna) that has a suitably keyed coupling.

In accordance with at least one embodiment of the invention, the craft may include an inertial measurement unit distinct from the inertial measurement unit of the calibration unit. During operation, an antenna pointing controller for the antenna may have access to inertial measurements made with the craft's inertial measurement unit. However, the inertial measurements made with the craft's inertial measurement unit may differ from those needed by the antenna pointing controller. For example, the antenna pointing controller may need to account for attitude offsets introduced when an antenna mount point is added to the craft. As described above, even small attitude differences can cause significant degradation in antenna performance. In accordance with at least one embodiment of the invention, a computing device may receive inertial measurements from the inertial measurement unit of the calibration unit and the inertial measurement unit of the craft (e.g., at the same time) and determine one or more calibration parameters that the antenna pointing controller can utilize to transform the inertial measurements provided with the craft's inertial measurement unit into values sufficient to enable relatively high performance antenna operation. Such calibration may be performed indoors, without immediate access to the antenna and without relocating critical aircraft components. Even with access to the antenna, an active communication link to a communication partner (e.g., a satellite) is not necessary for calibration in accordance with at least one embodiment of the invention.

For clarity, this description uses the example of an aircraft and a satellite antenna, however, each embodiment is not so limited. Examples of suitable crafts further include spacecraft, watercraft, vehicles such as automotive vehicles and rail vehicles, and any suitable mobile platform. Examples of suitable antennas further include antennas with improved performance when accurately and precisely pointed at a communication partner. FIG. 1 depicts aspects of an example calibration environment 100 in accordance with at least one embodiment of the invention. An aircraft 102 may include an internal reference unit (IRU) 104 configured to provide inertial measurements such as location and attitude (including yaw, roll and pitch) to an inertial guidance system 106. A keyed mount point 108 may be coupled with the aircraft 102, enabling mounting of a satellite antenna 110 with a correspondingly keyed coupling 112. Further details of the keyed mount point 108 are described below with reference to FIG. 2. In FIG. 1, the satellite antenna 110 is shown as unmounted. For example, the satellite antenna 110 may be in storage or in transit while a calibration procedure takes place. However, when mounted, the satellite antenna may be communicatively coupled with a data modem 114 to provide, for example, connectivity to a data network via satellite.

The data modem 114 may include, and/or at least partially implement, an antenna pointing controller 116. Alternatively, or in addition, the antenna pointing controller 116 may be wholly or partially included and/or implemented with one or more components of the satellite antenna 110. For example, the satellite antenna 110 may include one or more electric motors configured to change an attitude of one or more receivers of the satellite antenna 110 responsive to commands and/or signals provided with the data modem 114. In accordance with at least one embodiment of the invention, the satellite antenna 110 and keyed coupling 112 may be manufactured and calibrated such that, once mounted, the antenna pointing controller 116 may point the satellite antenna 110 with high precision (e.g., within 0.1 degrees) with respect to an initial reference attitude. Batches of satellite antennas and keyed couplings corresponding to the satellite antenna 110 and keyed coupling 112 may be manufactured and calibrated such that each satellite antenna in the batch may be pointed with high precision with respect to the initial reference attitude once mounted (e.g., may, to a high precision, have a common initial roll, pitch and yaw "zero" with respect to the mount point 108).

A keyed calibration unit 118 may include a suitably keyed coupling such that the calibration unit 118 may be mounted with the keyed mount point 108. The keyed nature of the mechanical coupling may provide that, when mounted, the calibration unit 118 and the satellite antenna 110 have a same unique mechanical alignment. Accordingly, inertial measurements with the calibration unit 118 may be applicable to the satellite antenna 110, which is not necessarily and/or repeatably the case without such a mechanical keying or, at least, may itself require significant calibration to achieve. The inertial measurements with the calibration unit 118 may be applicable to the satellite antenna 110 in that the mechanical keying may optimize (e.g., minimize) inertial measurement errors introduced by unmounting the calibration unit 118 and mounting the satellite antenna 110 in its place. In accordance with at least one embodiment of the invention, error introduced by unmounting the calibration unit 118 and mounting the satellite antenna 110 in its place may be less than the inherent error in the inertial measurements provided with the calibration unit 118 (e.g., less than 0.01 degrees for each of yaw, pitch and roll). For example, components involved in mechanical keying may be manufactured at least in part with a computerized numerical control (e.g., CNC) machining tool (may be manufactured with "CNC precision"). Further details of the keyed calibration unit 118 are described below with reference to FIG. 3.

In accordance with at least one embodiment of the invention, the data modem 114 (and thus the antenna pointing controller 116) may have access to inertial measurements made with the craft IRU 104. A computing device 120 may establish communication connections with the data modem 114 and the calibration unit 118. For example, the communication connections may be established with a conventional wireless local area network. The computing device 120 may receive inertial measurements from the craft IRU 104 and from the calibration unit 118, and utilize the two sets of inertial measurements to determine a set of antenna pointing controller calibration parameters. The computing device 120 may then configure the antenna pointing controller with the set of antenna pointing controller calibration parameters to allow the antenna pointing controller to utilize the antenna pointing controller calibration parameters to transform inertial measurements provided with the craft IRU 104 such that the transformed inertial measurements are applicable to the satellite antenna 110 (when mounted).

In accordance with at least one embodiment of the invention, the antenna pointing controller calibration parameters utilized by the antenna pointing controller to transform inertial measurements provided with the craft IRU 104 include fixed offsets for each of yaw, roll and pitch (ΔY, ΔR and ΔP, respectively), and the transformation of the inertial measurements provided with the craft IRU 104 includes a linear transformation of the yaw, roll and pitch measurements provided with the craft IRU 104 ($Y_v$, $R_v$ and $P_v$). For example:

$$(Y_m, R_m, P_m)=(Y_v, R_v, P_v)+(\Delta Y, \Delta R, \Delta P)$$

where $Y_m$, $R_m$ and $P_m$ are the yaw, roll and pitch of the mount point 108 and/or the reference yaw, roll and pitch for the satellite antenna 110 when mounted. The transformed yaw, roll and pitch ($Y_m$, $R_m$ and $P_m$), may correspond to inertial measurements that would be provided with an IRU mounted with the mount point 108, without the expense of incorporating a second IRU into the satellite antenna 110. In accordance with at least one embodiment of the invention, the transformed yaw, roll and pitch ($Y_m$, $R_m$ and $P_m$) may be provided to a conventional antenna pointing algorithm. Such algorithms are well known in the art, so only some details are described herein. For example, a satellite (not shown in FIG. 1) may be at a target azimuth and elevation relative to the aircraft's 102 current location (e.g., latitude, longitude, altitude as measured with the craft IRU 104), and the mounted satellite antenna 110 may be pointed at the target azimuth and elevation by rotating the satellite antenna 110 with respect to the transformed yaw, roll and pitch ($Y_m$, $R_m$ and $P_m$).

Figure 2:
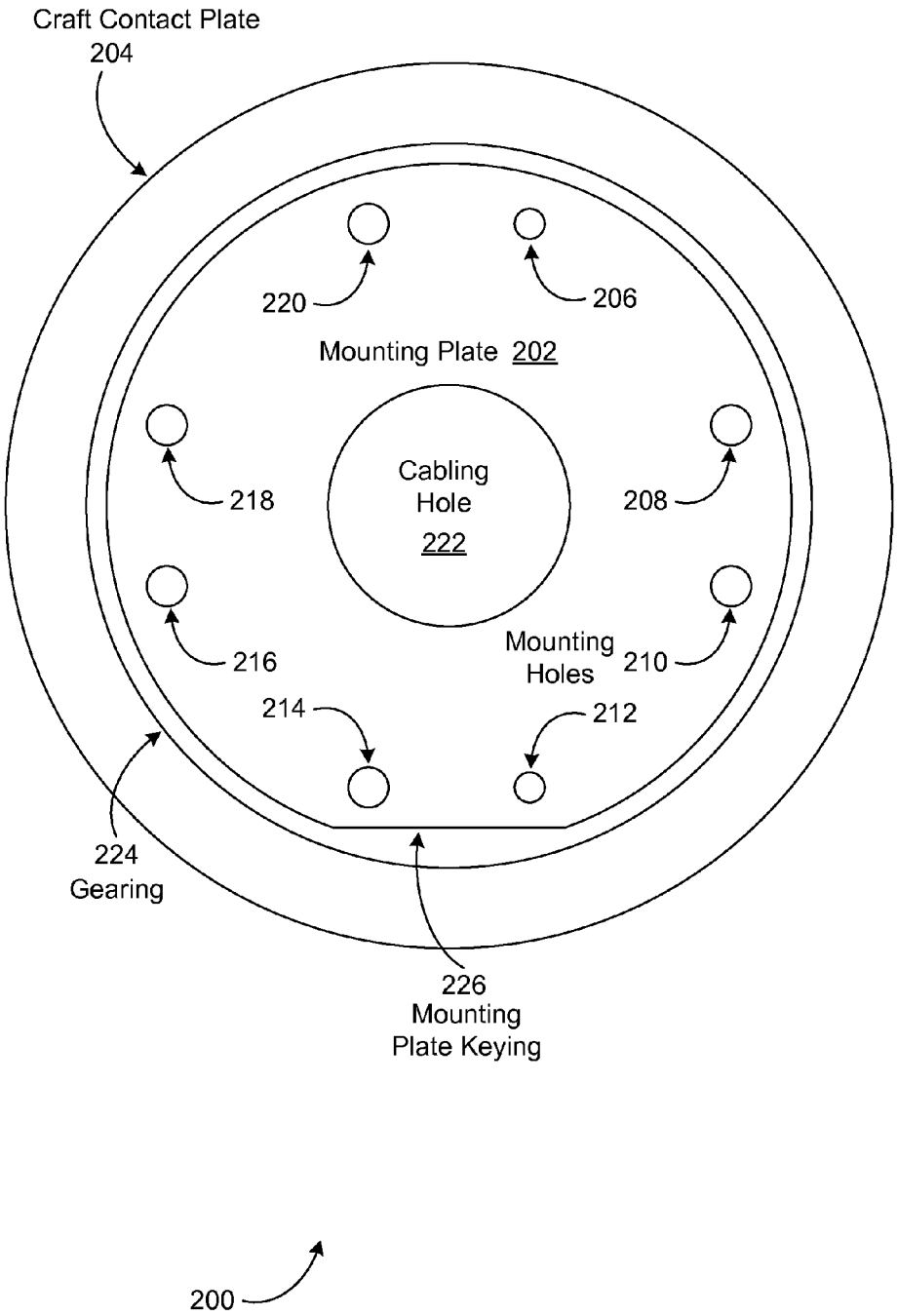
FIG. 2 is a schematic top view depicting aspects of example keyed mount point in accordance with at least one embodiment of the invention.

The keyed mount point 108 may incorporate any suitable mechanical keying mechanism. FIG. 2 depicts aspects of an example keyed mount point 200 in accordance with at least one embodiment of the invention. FIG. 2 is a schematic top view to clearly illustrate selected features and is not to scale. The keyed mount point 200 of FIG. 2 is an example of the keyed mount point 108 of FIG. 1. The keyed mount point 200 of FIG. 2 includes a mounting plate 202 connectively coupled with a craft contact plate 204. The craft contact plate 204 may be configured to couple with a mobile craft such as the aircraft 102. The craft contact plate 204 may incorporate conduits for cabling not shown in FIG. 2.

The mounting plate 202 may be configured to couple with any suitable structure, such as a rigid plate, having a corresponding keying. In the example depicted in FIG. 2, the mounting plate 202 includes multiple mounting holes 206, 208, 210, 212, 214, 216, 218, 220 arranged in a suitable pattern. The mounting plate 202 further includes a mounting plate keying feature 226. The keying of the mounting plate 202 may determine a unique alignment for mounted structures. For example, since fasteners (e.g., mounting bolts) that utilize the mounting holes 206, 208, 210, 212, 214, 216, 218, 220 may be inexactly sized with respect to the mounting holes 206, 208, 210, 212, 214, 216, 218, 220, some movement ("slop") of the fasteners with respect to the mounting holes 206, 208, 210, 212, 214, 216, 218, 220 may be possible. In accordance with at least one embodiment of the invention, the keying feature 226 optimizes (e.g., minimizes) such movement when the mounting plate 202 is coupled with a correspondingly keyed structure. The keying feature 226 is just one example of a suitable keying feature in accordance with at least one embodiment of the invention, and the keyed mount point 108 (FIG. 1) may incorporate any suitable keying. The mounting plate 202 may further include a center hole 222 for cabling, and may incorporate gearing 224 to facilitate rotation of the mounting plate 202 with a motor.

Figure 3:
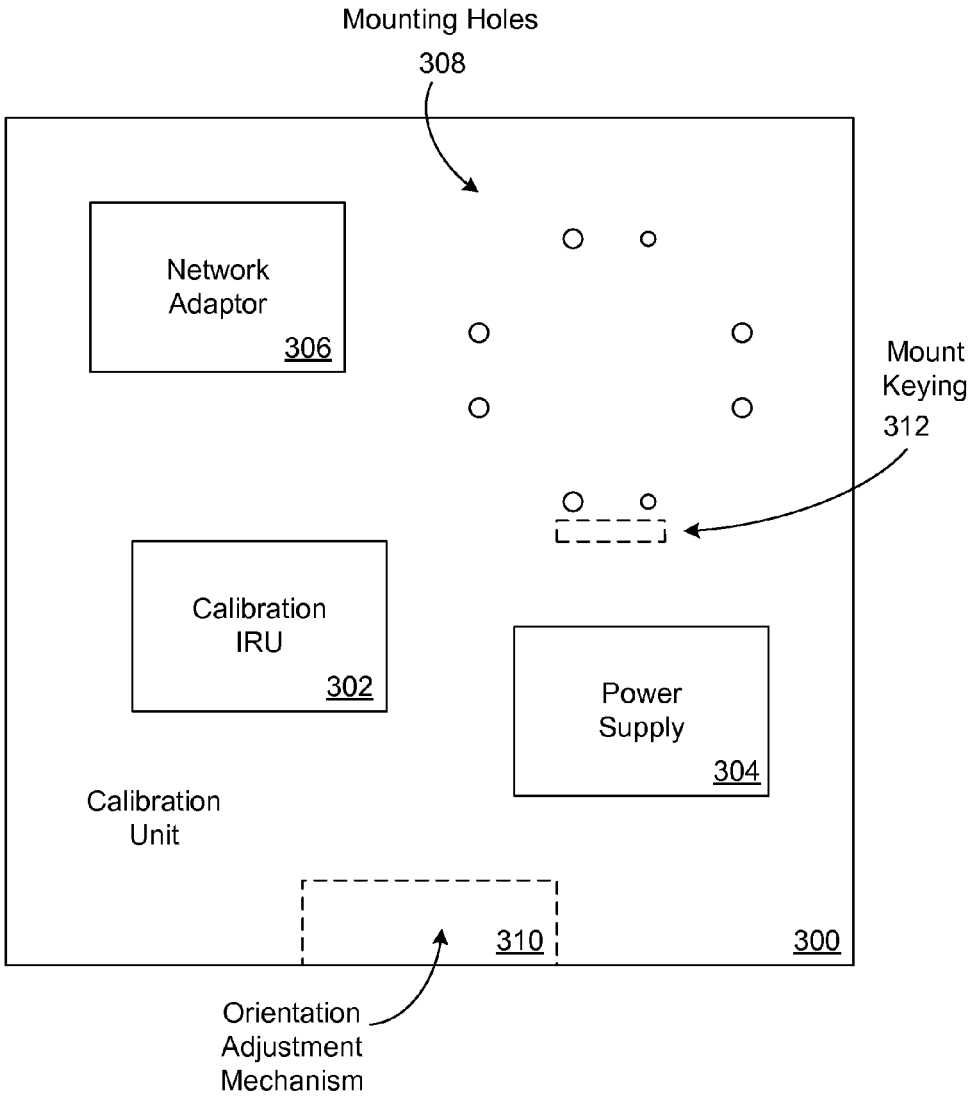
FIG. 3 is a schematic top view depicting aspects of an example calibration unit in accordance with at least one embodiment of the invention.

As described above, the calibration unit 118 (FIG. 1) may have a mechanical keying corresponding to the keying of the mounting plate 202. FIG. 3 depicts aspects of an example calibration unit 300 in accordance with at least one embodiment. FIG. 3 is a schematic top view to clearly illustrate selected features and is not to scale. The calibration unit 300 of FIG. 3 is an example of the keyed calibration unit 118 of FIG. 1. The calibration unit 300 of FIG. 3 may include an IRU 302 powered with a power supply 304 and communicatively coupled with a data network (not shown in FIG. 3) with a network adaptor 306. For example, the IRU 302 may be of a type corresponding to the type of the craft IRU 104. The power supply 304 may be a battery or other suitable portable power supply. The network adaptor 306 may provide connectivity to a conventional wireless local area network. The calibration unit 300 may further incorporate a mechanical keying corresponding to the keying of the mounting plate 202 (FIG. 2). For example, the calibration unit 300 may include a rigid plate having a pattern of mounting holes 308 corresponding to the mounting holes 206, 208, 210, 212, 214, 216, 218, 220 of the mounting plate 202, and a keying feature 312 corresponding to the keying feature 226 of the mounting plate 202. In FIG. 3, the keying feature 312 is depicted with a dashed line to indicate a protruding structure (e.g., a protruding block) beneath the rigid plate. The rigid plate may be connectively coupled with the IRU 302 such that inertial measurements with the IRU 302 are applicable to other keyed structures mounted with the keyed mount point 200.

In accordance with at least one embodiment of the invention, it may be that the calibration IRU 302 operates optimally (e.g., with low error) when it has an operating orientation that is within a specified variance from a reference orientation (e.g., within 2 degrees of level with respect to local sea level). In addition, it may be that the calibration unit 300, when initially mounted to a variety of craft, at times has an operating orientation that is outside of the specified variance for optimal operation. In accordance with at least one embodiment of the invention, the calibration unit 300 may incorporate an orientation adjustment mechanism 310 that is configured to adjust an orientation (e.g., an attitude) of the calibration unit 300 such that the operating orientation of the calibration unit 300 is changed to be within the specified variation. The orientation adjustment mechanism 310 may incorporate and/or utilize any suitable orientation adjustment mechanism including one or more adjustment screws and one or more shims from a set of shims of pre-defined sizes and/or that change an orientation angle by a pre-defined amount. For example, the set of shims may include particular shims that correspond to particular models and/or makes of craft. In accordance with at least one embodiment of the invention, the orientation adjustment mechanism 310 enables the calibration unit 300 to be optimized for multiple types of craft.

Figure 4:
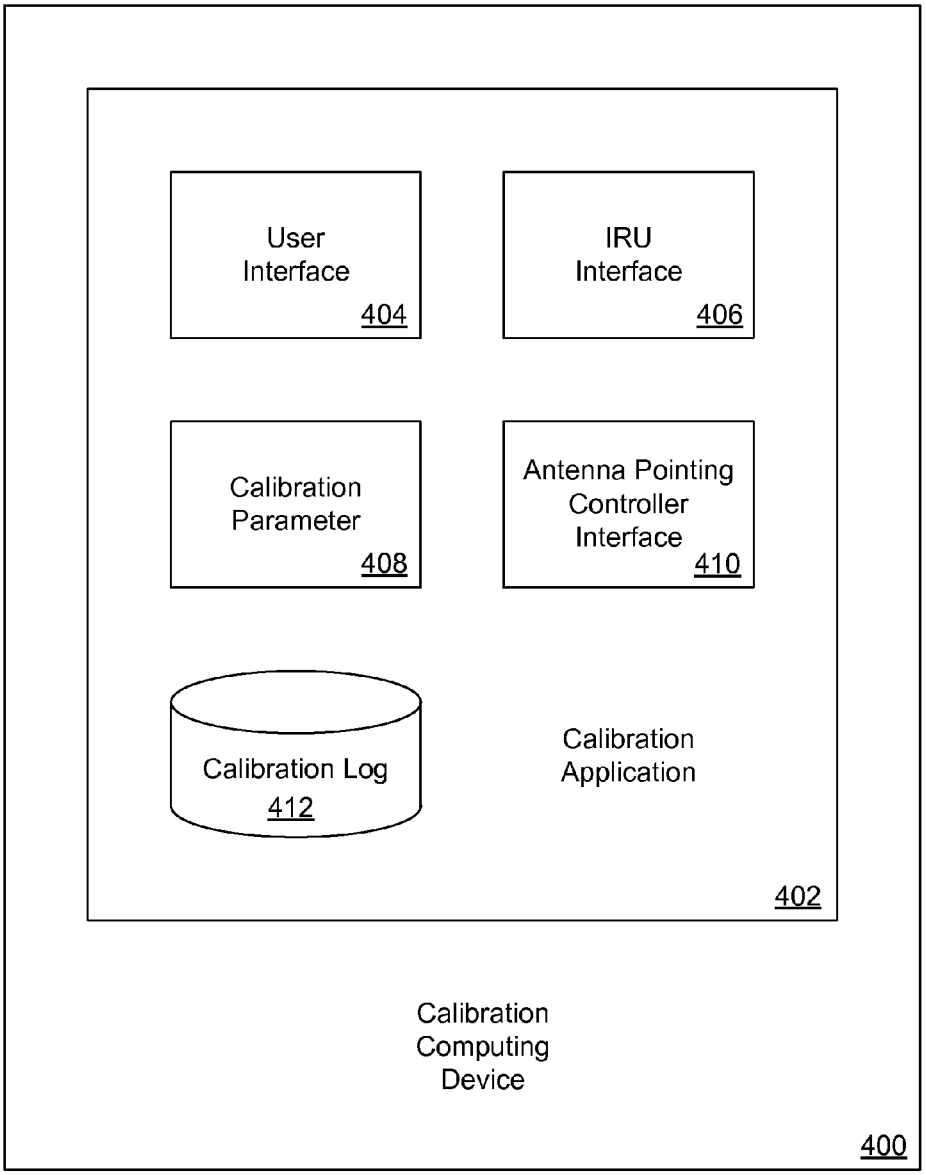
FIG. 4 is a schematic diagram depicting aspects of an example calibration computing device in accordance with at least one embodiment of the invention.

When the calibration unit 300 is mounted with the keyed mount point 108 as depicted in FIG. 1, the computing device 120 may obtain inertial measurements from both the craft IRU 104 and the calibration IRU 302. FIG. 4 depicts aspects of an example calibration computing device 400 in accordance with at least one embodiment of the invention. The calibration computing device 400 of FIG. 4 is an example of the computing device 120 of FIG. 1. The calibration computing device 400 may incorporate, or be incorporated by, any suitable computing device including a personal computer, a laptop computer, a tablet computer, a notebook computer, a personal digital assistant (PDA), a smart phone, a workstation, a server and a computer. An example of a suitable computing device is described below in more detail with reference to FIG. 6.

The calibration computing device 400 may host and/or implement one or more computing applications. For example, such applications may include one or more collections of computing components, including collections of data and computer-executable instructions, that cooperate to provide a set of functionality. In particular, the calibration computing device 400 may include a calibration application 402 configured to configure the antenna pointing controller 116 (FIG. 1) based on data received from the craft IRU 104 and the mounted calibration unit 118.

The calibration application 402 may include a user interface 404 such as a graphical user interface (GUI) configured to enable a user (e.g., an antenna calibration technician) to access and/or activate the functionality of the calibration application 402. For example, the user may request that the calibration application 402 determine a suitable set of antenna pointing controller calibration parameters. The calibration application 402 may interact with the craft IRU 104 (FIG. 1) and the mounted calibration unit 118 through an IRU interface 406 to obtain corresponding (e.g., simultaneous) inertial measurements, and a calibration parameter module 408 may determine the set of requested calibration parameters based on the obtained inertial measurements. For example, the calibration parameter module 408 may determine a difference (e.g., an average difference) between the two sets of inertial measurements during a time period (e.g., 10 minutes). In accordance with at least one embodiment of the invention, the set of requested calibration parameters may be further based on one or more settings of the calibration unit orientation adjustment mechanism 310 of FIG. 3 (e.g., one or more installed shim sizes). The antenna pointing controller 116 may be configured with the determined calibration parameters through an antenna pointing controller interface 410. In accordance with at least one embodiment of the invention, the antenna pointing controller interface 410 may incorporate, or be incorporated by, a data modem interface (not separately shown in FIG. 4) configured to provide access to the data modem 114, and thus the antenna pointing controller 116. Details of the calibration process may be recorded in a calibration log 412 for later reference, diagnostics and/or auditing.

Calibration logs 412 may be organized by time and/or craft. For example, each calibration may be associated with a particular craft serial number and/or craft type, as well as a calibration start date and/or time ("datetime") and a calibration end datetime. The user interface 404 may enable the user to create new calibration records, open existing calibration records, update existing calibration records and delete existing calibration records. The calibration may further be associated with a particular location, for example, a particular latitude, longitude and altitude of the craft. In accordance with at least one embodiment of the invention, an explicit and/or measured altitude is not required for the calibration process. The user interface 404 may enable the user to input the location, for example, as specified with latitude and longitude co-ordinates to 0.01 degree accuracy and/or with a location code such as an airport code. When the computing device is communicatively coupled with the craft IRU 104 (FIG. 1) and/or the calibration IRU 302 (FIG. 3) with one or more communication ports (e.g., serial communication ports), the user interface 404 may enable specification of the communication port(s).

Responsive to a user request to initiate calibration, the calibration application 402 may create a calibration record in the calibration log 412. The calibration record may include some or all calibration events that occur during the calibration. The calibration events may be recorded in the calibration record and presented to the user with the user interface 404. Examples of calibration events that may be recorded include calibration record created, error conditions such as communication failures and/or failures to establish reliable communication connections, component access events including IRU access events, commands sent to components such as IRUs, data received from components such as IRUs including roll, pitch and yaw and measurement statistics such as maximum, minimum, average and standard deviation of measured values during a measurement time period, and calibration record closed.

The user interface 404 may present calibration status (e.g., calibration in progress, calibration complete) and calibration results such as antenna pointing controller calibration parameters (e.g., $\Delta Y$, $\Delta R$ and $\Delta P$) in a separate section and/or with a distinct visual emphasis. Some craft may have multiple keyed mount points such as the keyed mount point 108 of FIG. 1, for example, there may be one mount point above the fuselage as depicted in FIG. 1 and another mount below the fuselage. The user interface 404 may provide separate interface elements (e.g., buttons) to activate a calibration associated with each such mount point and/or to provide a visual checklist with respect to calibration progress including an indication of which mount points have been calibrated and which remain to be calibrated.

Figure 5:
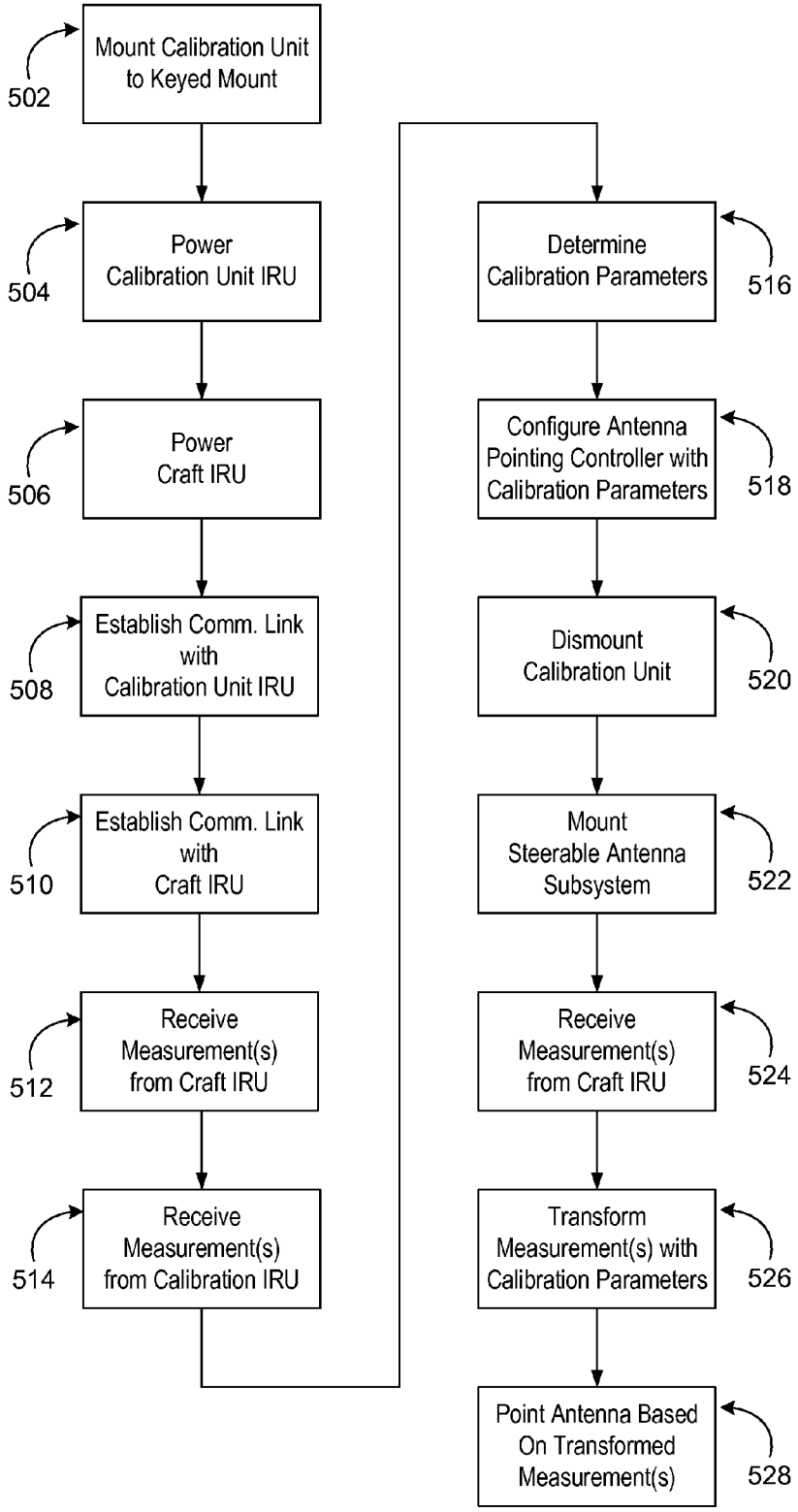
FIG. 5 is a flowchart depicting example steps in accordance with at least one embodiment of the invention.

The description now turns to procedures that may be performed in accordance with at least one embodiment of the invention. For example, such procedure may be performed with one or more components of the calibration environment 100 (FIG. 1). FIG. 5 depicts example steps that may be performed in accordance with at least one embodiment of the invention. At step 502, a calibration unit may be mounted to a keyed mount. For example, the keyed calibration unit 118 may be mounted to the keyed mount point 108. At step 504, a calibration unit IRU may be powered up. For example, the calibration IRU 302 (FIG. 3) may be powered with the power supply 304 responsive to user interaction with the calibration unit 300. At step 506, a craft IRU may be powered up. For example, power may be supplied to the craft IRU 104 responsive to user interaction with a control panel of the inertial guidance system 106.

At step 508, a communication link may be established with the calibration IRU. For example, the computing device 120 (FIG. 1) may establish a communication link with the calibration IRU 302 (FIG. 3) utilizing the network adaptor 306. At step 510, another communication link may be established with the craft IRU. For example, the computing device 120 may establish a communication link with the craft IRU 104 utilizing the data modem 114. At step 512, one or more measurements may be received from the craft IRU. For example, the computing device 120 may receive inertial measurements from the craft IRU 104 through the communication link established at step 510 and responsive to a request from the computing device 120. At step 514, measurements may be received from the calibration IRU. For example, the computing device 120 may receive corresponding inertial measurements from the calibration IRU 302 though the communication link established at step 508 and responsive to a request from the computing device 120.

At step 516, one or more calibration parameters may be determined. For example, the calibration parameter module 408 (FIG. 4) may determine a set of antenna pointing controller calibration parameters (e.g., ΔY, ΔR and ΔP) based on the measurements received at step 512 and step 514. At step 518, an antenna pointing controller may be configured with the calibration parameters determined at step 516. For example, the computing device 120 (FIG. 1) may configure the antenna pointing controller 116 with the antenna pointing controller calibration parameters. At step 502, the calibration unit may be dismounted. For example, the calibration unit 118 (FIG. 1) may be dismounted from the mount point 108.

At step 522, a steerable antenna subsystem may be mounted. For example, the satellite antenna 110 (FIG. 1) may be mounted with the keyed mount point 108. The mounting of the steerable antenna subsystem (sometimes called a line replaceable unit or LRU) may occur at any suitable time after the calibration process (e.g., steps 502-520). In addition, the steerable antenna subsystem may be dismounted, replaced or repaired and remounted without a need for recalibration.

At step 524, one or more measurements may be received from the craft IRU. For example, the data modem 114 (FIG. 1) and/or the antenna pointing controller 116 may receive a set of inertial measurements from the craft IRU 104 (e.g., $Y_v$, $R_v$ and $P_v$). At step 526, the measurement(s) may be transformed based on the calibration parameters configured at step 518. For example, the data modem 114 and/or the antenna pointing controller 116 may transform the set of inertial measurements obtained from the craft IRU 104 to obtain a corresponding set of transformed inertial measurements that are applicable to the steerable antenna subsystem mounted at step 522 (e.g., $Y_m$, $R_m$ and $P_m$). At step 528, the steerable antenna subsystem may be pointed based on the transformed measurement(s) of step 526. For example, the antenna pointing controller 116, and/or a corresponding module incorporated into the satellite antenna 110, may point the satellite antenna 110 at a target satellite location relative to the transformed roll, pitch and yaw (e.g., $Y_m$, $R_m$ and $P_m$).

Figure 6:
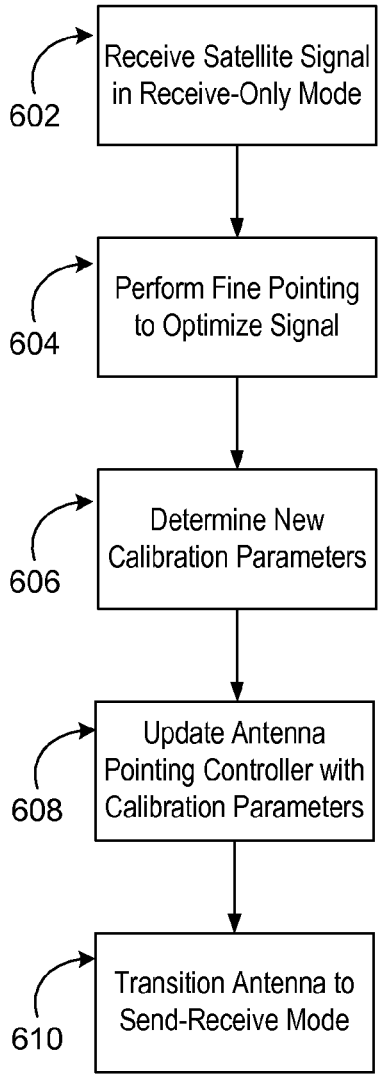
FIG. 6 is a flowchart depicting further example steps in accordance with at least one embodiment of the invention.

The calibration parameters of step 516 may be determined without reference to a satellite signal. In accordance with at least one embodiment of the invention, the calibration parameters may be determined with sufficient precision (e.g., within 0.1-0.2 degrees) to enable full duplex communication between the mounted satellite antenna 110 (FIG. 1) and the target satellite. However, in accordance with at least one alternate embodiment, the initial precision achieved by the calibration parameters is coarse (e.g., greater than 0.1-0.2 degrees but within 0.5-1.0 degree), and additional steps are required to update the calibration parameters to achieve fine precision pointing (e.g., within 0.1-0.2 degrees). FIG. 6 depicts example steps that may be performed in accordance with the at least one alternate embodiment.

At step 602, a signal from the target satellite may be received by the satellite antenna 110 in receive-only mode. For example, to prevent interference with "adjacent" satellites, communication regulations may prohibit full duplex communication without achieving fine precision pointing of the satellite antenna 110 (FIG. 1), but permit receive-only operation of the satellite antenna 110. When only coarse precision has been achieved, the signal received at step 602 may be less than optimal, for example, with respect to signal strength and/or signal-to-noise ratio. At step 604, fine pointing of the satellite antenna 110 may be performed to optimize the received signal from the target satellite. For example, the antenna pointing controller 116 may move the satellite antenna 110 in order to optimize one or more attributes of the received signal. Any suitable antenna pointing adjustment algorithm may be utilized. Such algorithms are well known in the art and need not be described here in detail.

At step 606, new calibration parameters may be determined. For example, the antenna pointing controller 116 may track cumulative changes to yaw, pitch and roll relative to inertial measurements by the craft IRU 104 during the fine pointing of step 604, and may determine the new calibration parameters based on the calibration parameters determined at step 516 (FIG. 5) and the tracked cumulative changes to yaw, pitch and roll. Where the calibration parameters correspond to yaw, pitch and roll offsets, the offsets may be updated with the tracked cumulative changes (e.g., with a linear transform). At step 608, the antenna pointing controller 116 may be updated with the new calibration parameters. For example, the calibration parameters determined at step 516 may be overwritten with the new calibration parameters determined at step 606. At step 610, the satellite antenna 110 (FIG. 1) may be transitioned to send-receive mode. It may be that steps 602-610 need only be performed once after installation of a new satellite antenna (e.g., during a next aircraft flight). However, the steps 602-610 may be repeated if necessary.

Figure 7:
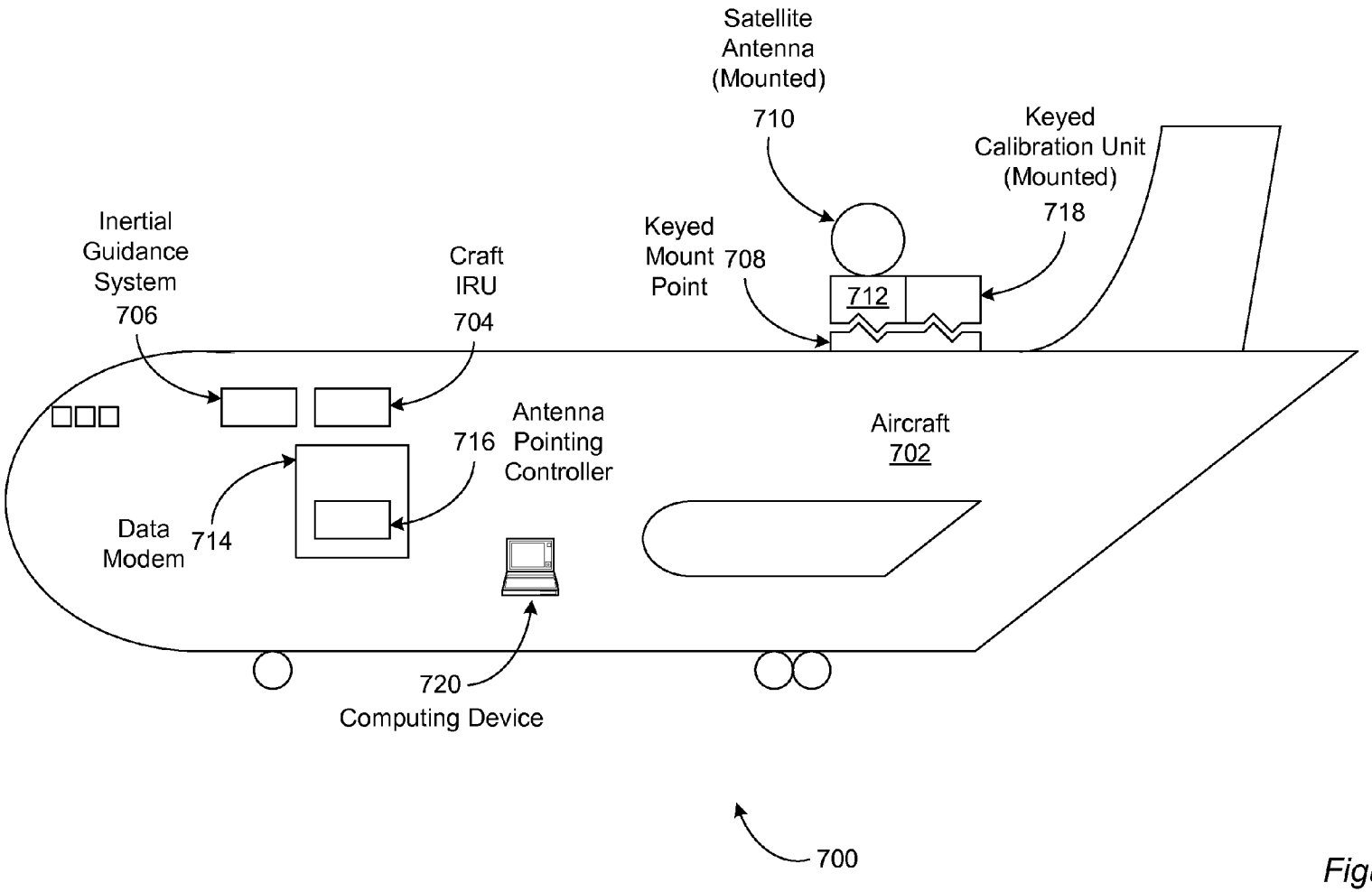
FIG. 7 is a schematic diagram depicting aspects of another example calibration environment in accordance with at least one embodiment of the invention.

In the example depicted in FIG. 1, the calibration unit 118 is shown mounted to the keyed mount point 108 and, in order to mount the satellite antenna 110, the calibration unit 118 is first dismounted. FIG. 7 depicts an alternate example in accordance with at least one embodiment of the invention. The example depicted in FIG. 7 includes a calibration environment 700 and components 702, 704, 706, 708, 710, 712, 714, 716, 718, 720 corresponding to the environment 100 and components 102, 104, 106, 108, 110, 112, 114, 116, 118, 120, respectively, of the example depicted in FIG. 1. However, in the example of FIG. 7, the keyed mount point 708 is capable of simultaneously mounting both the calibration unit 718 and the satellite antenna 710. For example, the keyed mount point 708 may incorporate multiple sets of mounting holes and keying features corresponding to the mounting holes 206, 208, 210, 212, 214, 216, 218, 220 and keying feature 226 of FIG. 2. The keyed mount point 708 may be manufactured as single unit (e.g., as part of a single CNC manufacturing process) such that the attitude offset between the mounted satellite antenna 710 and the simultaneously mounted calibration unit 718 (the "co-mounted offset") is known with high precision (e.g., CNC precision). Calibration parameter determinations such as step 516 (FIG. 5) may take into account this attitude offset.

Figure 8:
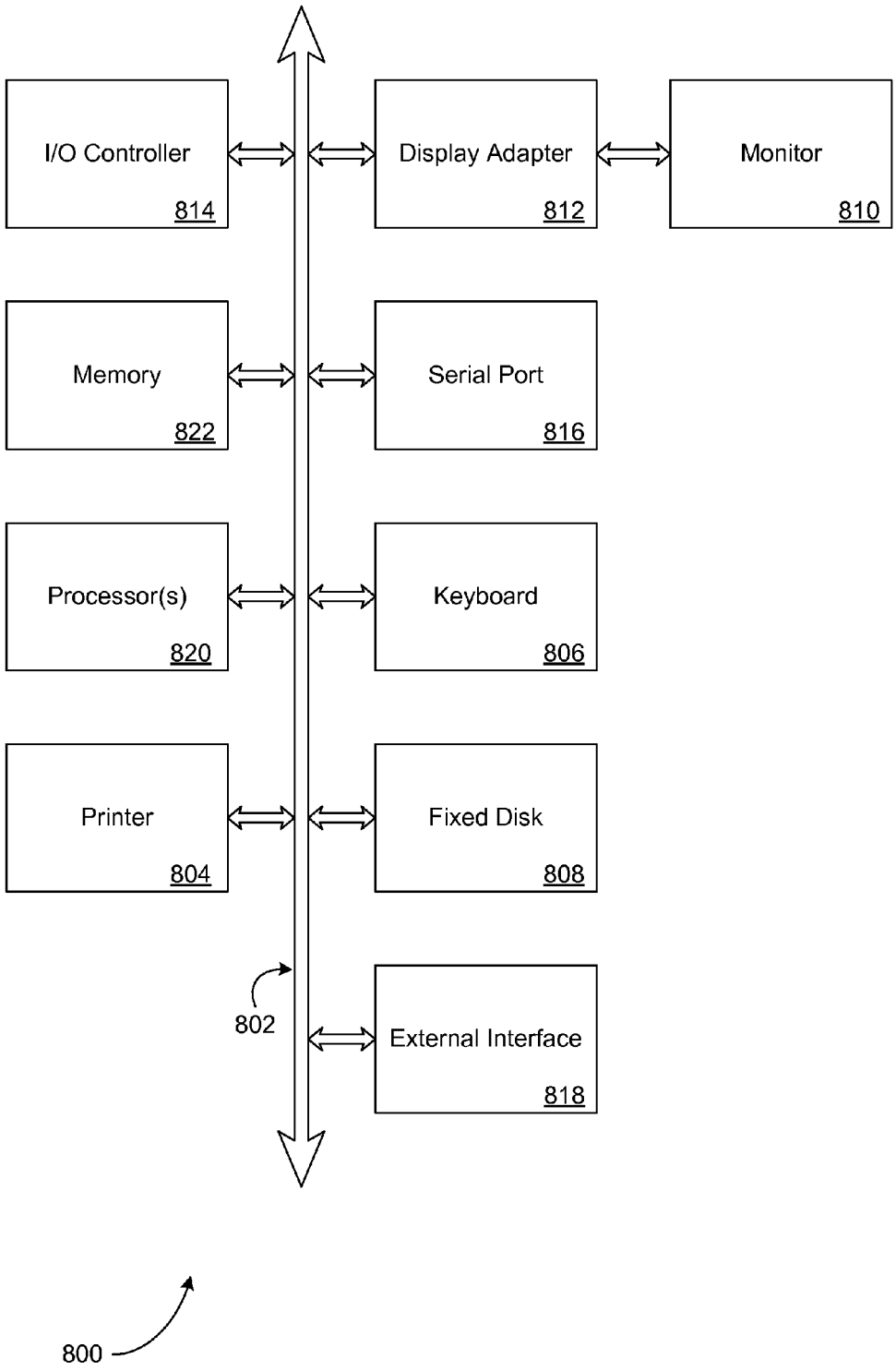
FIG. 8 is a schematic diagram depicting aspects of an example computing device in accordance with at least one embodiment of the invention.

In accordance with at least one embodiment of the invention, the system, apparatus, methods, processes and/or operations described above may be wholly or partially implemented in the form of a set of instructions executed by one or more programmed computer processors such as a central processing unit (CPU) or microprocessor. Such processors may be incorporated in an apparatus, server, client or other computing device operated by, or in communication with, other components of the system. As an example, FIG. 8 depicts aspects of elements that may be present in a computing device and/or system 800 configured to implement a method and/or process in accordance with some embodiments of the present invention. The subsystems shown in FIG. 8 are interconnected via a system bus 802. Additional subsystems include a printer 804, a keyboard 806, a fixed disk 808, and a monitor 810, which is coupled to a display adapter 812. Peripherals and input/output (I/O) devices, which couple to an I/O controller 814, can be connected to the computer system with any number of means known in the art, such as a serial port 816. For example, the serial port 816 or an external interface 818 can be utilized to connect the computing device 800 to further devices and/or systems not shown in FIG. 8 including a wide area network such as the Internet, a mouse input device, and/or a scanner. The interconnection via the system bus 802 allows one or more processors 820 to communicate with each subsystem and to control the execution of instructions that may be stored in a system memory 822 and/or the fixed disk 808, as well as the exchange of information between subsystems. The system memory 822 and/or the fixed disk 808 may embody a tangible, non-transitory computer-readable medium.

The description now turns to various examples in accordance with at least one embodiment of the invention. The examples are numbered for ease of reference.

Example 1 is a method for antenna pointing controller calibration, including: mounting, with a mount point of a craft incorporating a first inertial measurement unit, a calibration unit incorporating a second inertial measurement unit; receiving, from the first inertial measurement unit, a first inertial measurement; receiving, from the second inertial measurement unit, a second inertial measurement; and determining an antenna pointing controller calibration parameter based at least in part on the first inertial measurement and the second inertial measurement.

Example 2 is a method in accordance with Example 1, wherein the mount point incorporates a mechanical keying, the calibration unit incorporates a first coupling adapted to the mechanical keying and an antenna subsystem incorporates a second coupling adapted to the mechanical keying, such that inertial measurements with the calibration unit are applicable to the antenna subsystem. Example 3 is a method in accordance with Example 2, wherein the mechanical keying comprises a keying feature arranged to determine a unique mounting alignment with respect to a plurality of mounting holes. Example 4 is a method in accordance with Example 2 or 3, wherein the mount point is adapted to simultaneously mount the calibration unit and the antenna subsystem. Example 5 is a method in accordance with Example 1-3 or 4, further comprising: configuring an antenna pointing controller with the antenna pointing controller calibration parameter; optimizing a signal received at an antenna subsystem mounted with the mount point at least in part by moving the antenna subsystem with the antenna pointing controller; determining a new value for the antenna pointing controller calibration parameter based at least in part on the optimizing; and configuring the antenna pointing controller with the new value for the antenna pointing controller calibration parameter.

Example 6 is a method in accordance with Example 1-4 or 5, further including: configuring an antenna pointing controller based at least in part on the antenna pointing controller calibration parameter; dismounting the calibration unit from the mount point of the craft; and mounting a steerable antenna subsystem with the mount point of the craft. Example 7 is a method in accordance with Example 6, further including: receiving, from the first inertial measurement unit, a third inertial measurement; transforming the third inertial measurement based at least in part on the antenna pointing controller calibration parameter; and pointing the steerable antenna subsystem based at least in part on the transformed third inertial measurement.

Example 8 is a method in accordance with Example 1-6 or 7, wherein the first and second inertial measurements correspond to one of: yaw, roll and pitch. Example 9 is a method in accordance with Example 1-7 or 8, further including determining a plurality of antenna pointing controller calibration parameters based at least in part on a plurality of inertial measurements received from the first inertial measurement unit and the second inertial measurement unit, the plurality of inertial measurements including inertial measurements corresponding to each of: yaw, roll and pitch. Example 10 is a method in accordance with Example 1-8 or 9, wherein the mount point is adapted to mount a steerable antenna subsystem. Example 11 is a method in accordance with Example 10, wherein the steerable antenna subsystem is a subsystem of a satellite antenna.

Example 12 is a method in accordance with Example 1-10 or 11, wherein the mount point is physically distant from the first inertial measurement unit. Example 13 is a method in accordance with Example 1-11 or 12, wherein the craft corresponds to at least one of: a watercraft, an aircraft and a spacecraft. Example 14 is a method in accordance with Example 1-12 or 13, wherein inertial guidance of the craft is based at least in part on data received from the first inertial measurement unit.

Example 15 is an apparatus for antenna pointing controller calibration, including: a first inertial measurement unit; a power source that is electrically coupled with the first inertial measurement unit; and a first coupling that is connectively coupled with the first inertial measurement unit and that is adapted to a mechanical keying of a mount point of a craft such that inertial measurements with the first inertial measurement unit are applicable to an antenna subsystem incorporating a second coupling that is adapted to the mechanical keying of the mount point of the craft.

Example 16 is an apparatus in accordance with Example 15, wherein the mechanical keying determines a unique alignment of the apparatus when the apparatus is mounted with the mount point of the craft. Example 17 is an apparatus in accordance with Example 16, wherein the mechanical keying determines an alignment of the antenna subsystem that corresponds to the unique alignment when the antenna subsystem is mounted with the mount point of the craft. Example 18 is an apparatus in accordance with Example 15-16 or 17, wherein the first coupling comprises a rigid plate.

Example 19 is an apparatus in accordance with Example 15-17 or 18, further including a computing device communicatively coupled with the first inertial measurement unit and a second inertial measurement unit of the craft, the computing device configured to: receive, from the first inertial measurement unit, a first inertial measurement; receive, from the second inertial measurement unit, a second inertial measurement; and determine an antenna pointing controller calibration parameter based at least in part on the first inertial measurement and the second inertial measurement. Example 20 is an apparatus in accordance with Example 19, wherein inertial guidance of the craft is based at least in part on data received from the second inertial measurement unit.

Example 21 is an apparatus in accordance with Example 15-19 or 20, wherein the computing device is further configured to configure an antenna pointing controller based at least in part on the antenna pointing controller calibration parameter. Example 22 is an apparatus in accordance with Example 15-20 or 21, wherein the power source comprises a battery. Example 23 is an apparatus in accordance with Example 15-21 or 22, wherein the mechanical keying comprises a keying feature arranged to determine a unique mounting alignment with respect to a plurality of mounting holes. Example 24 is an apparatus in accordance with Example 23, wherein the keying feature corresponds to a chord of a circular mounting plate of the mount point. Example 25 is an apparatus in accordance with Example 15-23 or 24, wherein the mount point is adapted to simultaneously mount the apparatus and the antenna subsystem.

Example 26 is an apparatus in accordance with Example 15-24 or 25, wherein at least one of the inertial measurements with the first inertial measurement unit correspond to at least one of: yaw, roll and pitch. Example 27 is an apparatus in accordance with Example 15-25 or 26, wherein at least one of the inertial measurements with the first inertial measurement unit correspond to each of: yaw, roll and pitch. Example 28 is an apparatus in accordance with Example 15-26 or 27, wherein the antenna subsystem is a steerable antenna subsystem. Example 29 is an apparatus in accordance with Example 28, wherein the steerable antenna subsystem is a subsystem of a satellite antenna. Example 30 is an apparatus in accordance with Example 15-28 or 29, wherein the mount point is physically distant from the first inertial measurement unit. Example 31 is an apparatus in accordance with Example 15-29 or 30, wherein the craft corresponds to at least one of: a watercraft, an aircraft and a spacecraft.

Example 32 is a computer-readable medium having thereon computer-executable instructions that, when executed by a computing device, cause the computing device to, at least: receive, from a first inertial measurement unit of a craft, a first inertial measurement; receive, from a second inertial measurement unit of a calibration unit mounted to a mount point of the craft, a second inertial measurement; and determine an antenna pointing controller calibration parameter based at least in part on the first inertial measurement and the second inertial measurement.

Example 33 is a computer-readable medium in accordance with Example 32, wherein the computer-executable instructions further cause the computing device to configure an antenna pointing controller based at least in part on the antenna pointing controller calibration parameter. Example 34 is a computer-readable medium in accordance with Example 32 or 33, wherein the computer-executable instructions further cause the computing device to establish a first communication connection with the first inertial measurement unit of the craft and establish a second communication connection with the second inertial measurement unit of the calibration unit. Example 35 is a computer-readable medium in accordance with Example 32-33 or 34, wherein the first inertial measurement and the second inertial measurement are received substantially simultaneously.

Example 36 is a computer-readable medium in accordance with Example 32-34 or 35, wherein the computer-executable instructions further cause the computing device to provide the antenna pointing controller calibration parameter for presentation at a graphical user interface. Example 37 is a computer-readable medium in accordance with Example 32-35 or 36, wherein the first and second inertial measurements correspond to one of: yaw, roll and pitch. Example 38 is a computer-readable medium in accordance with Example 32-36 or 37, wherein the computer-executable instructions further cause the computing device to determine a plurality of antenna pointing controller calibration parameters based at least in part on a plurality of inertial measurements received from the first inertial measurement unit and the second inertial measurement unit, the plurality of inertial measurements including inertial measurements corresponding to each of: yaw, roll and pitch.

Example 39 is a computer-readable medium in accordance with Example 32-37 or 38, wherein the mount point incorporates a mechanical keying, the calibration unit incorporates a first coupling adapted to the mechanical keying and an antenna subsystem incorporates a second coupling adapted to the mechanical keying, such that inertial measurements with the calibration unit are applicable to the antenna subsystem. Example 40 is a computer-readable medium in accordance with Example 39, wherein the mechanical keying comprises a keying feature arranged to determine a unique mounting alignment with respect to a plurality of mounting holes. Example 41 is a computer-readable medium in accordance with Example 39 or 40, wherein the mount point is adapted to simultaneously mount the calibration unit and the antenna subsystem. Example 42 is a computer-readable medium in accordance with Example 32-40 or 41, wherein the computer-executable instructions further cause the computing device to, at least: configure an antenna pointing controller with the antenna pointing controller calibration parameter; optimize a signal received at an antenna subsystem mounted with the mount point at least in part by moving the antenna subsystem with the antenna pointing controller; determine a new value for the antenna pointing controller calibration parameter based at least in part on the optimizing; and configure the antenna pointing controller with the new value for the antenna pointing controller calibration parameter.

Example 43 is a computer-readable medium in accordance with Example 32-41 or 42, wherein the mount point is adapted to mount a steerable antenna subsystem. Example 44 is a computer-readable medium in accordance with Example 43, wherein the steerable antenna subsystem is a subsystem of a satellite antenna. Example 45 is a computer-readable medium in accordance with Example 32-43 or 44, wherein the mount point is physically distant from the first inertial measurement unit. Example 46 is a computer-readable medium in accordance with Example 32-44 or 45, wherein the craft corresponds to at least one of: a watercraft, an aircraft and a spacecraft. Example 47 is a computer-readable medium in accordance with Example 32-45 or 46, wherein inertial guidance of the craft is based at least in part on data received from the first inertial measurement unit.

All references, including publications, patent applications, and patents, cited herein are hereby incorporated by reference to the same extent as if each reference were individually and specifically indicated to be incorporated by reference and/or were set forth in its entirety herein.

The use of the terms "a" and "an" and "the" and similar referents in the specification and in the following claims are to be construed to cover both the singular and the plural, unless otherwise indicated herein or clearly contradicted by context. The terms "having," "including," "containing" and similar referents in the specification and in the following claims are to be construed as open-ended terms (e.g., meaning "including, but not limited to,") unless otherwise noted. Recitation of ranges of values herein are merely indented to serve as a shorthand method of referring individually to each separate value inclusively falling within the range, unless otherwise indicated herein, and each separate value is incorporated into the specification as if it were individually recited herein. All methods described herein can be performed in any suitable order unless otherwise indicated herein or clearly contradicted by context. The use of any and all examples, or exemplary language (e.g., "such as") provided herein, is intended merely to better illuminate embodiments of the invention and does not pose a limitation to the scope of the invention unless otherwise claimed. No language in the specification should be construed as indicating any non-claimed element as essential to each embodiment of the present invention.

Numerical data may be expressed or presented herein in a range format. It is to be understood that such a range format is used merely for convenience and brevity and thus should be interpreted flexibly to include not only the numerical values explicitly recited as the limits of the range, but also interpreted to include all of the individual numerical values or sub-ranges encompassed within that range as if each numerical value and sub-range is explicitly recited. As an illustration, a numerical range of "about 1 to 5" should be interpreted to include not only the explicitly recited values of about 1 to about 5, but also include individual values and sub-ranges within the indicated range. Thus, included in this numerical range are individual values such as 2, 3 and 4 and sub-ranges such as 1-3, 2-4 and 3-5, etc. This same principle applies to ranges reciting only one numerical value (e.g., "greater than about 1") and should apply regardless of the breadth of the range or the characteristics being described. A plurality of items may be presented in a common list for convenience. However, these lists should be construed as though each member of the list is individually identified as a separate and unique member. Thus, no individual member of such list should be construed as a de facto equivalent of any other member of the same list solely based on their presentation in a common group without clear indication to the contrary.

As used herein, the term "alternatively" refers to selection of one of two or more alternatives, and is not intended to limit the selection to only those listed alternatives or to only one of the listed alternatives at a time, unless the context clearly indicates otherwise. The term "substantially" means that the recited characteristic, parameter, or value need not be achieved exactly, but that deviations or variations, including for example, tolerances, measurement error, measurement accuracy limitations and other factors known to those of skill in the art, may occur in amounts that do not preclude the effect the characteristic was intended to provide.

Different arrangements of the components depicted in the drawings or described above, as well as components and steps not shown or described are possible. Similarly, some features and subcombinations are useful and may be employed without reference to other features and subcombinations. Embodiments of the invention have been described for illustrative and not restrictive purposes, and alternative embodiments will become apparent to readers of this patent. Accordingly, the present invention is not limited to the embodiments described above or depicted in the drawings, and various embodiments and modifications can be made without departing from the scope of the claims below.

That which is claimed is:

1. A method for antenna pointing controller calibration, comprising:

mounting, with a mount point of a craft incorporating a first inertial measurement unit, a calibration unit incorporating a second inertial measurement unit;

receiving, from the first inertial measurement unit, a first inertial measurement;

receiving, from the second inertial measurement unit, a second inertial measurement; and determining an antenna pointing controller calibration parameter based at least in part on the first inertial measurement and the second inertial measurement.

2. A method in accordance with claim 1, wherein the mount point incorporates a mechanical keying, the calibration unit incorporates a first coupling adapted to the mechanical keying and an antenna subsystem incorporates a second coupling adapted to the mechanical keying, such that inertial measurements with the calibration unit are applicable to the antenna subsystem.

3. A method in accordance with claim 2, wherein the mechanical keying comprises a keying feature arranged to determine a unique mounting alignment with respect to a plurality of mounting holes.

4. A method in accordance with claim 2, wherein the mount point is adapted to simultaneously mount the calibration unit and the antenna subsystem.

5. A method in accordance with claim 1, further comprising:

configuring an antenna pointing controller with the antenna pointing controller calibration parameter;

optimizing a signal received at an antenna subsystem mounted with the mount point at least in part by moving the antenna subsystem with the antenna pointing controller;

determining a new value for the antenna pointing controller calibration parameter based at least in part on the optimizing; and configuring the antenna pointing controller with the new value for the antenna pointing controller calibration parameter.

6. A method in accordance with claim 1, further comprising:

configuring an antenna pointing controller based at least in part on the antenna pointing controller calibration parameter;

dismounting the calibration unit from the mount point of the craft; and mounting a steerable antenna subsystem with the mount point of the craft.

7. A method in accordance with claim 6, further comprising:

receiving, from the first inertial measurement unit, a third inertial measurement;

transforming the third inertial measurement based at least in part on the antenna pointing controller calibration parameter; and pointing the steerable antenna subsystem based at least in part on the transformed third inertial measurement.

8. A method in accordance with claim 1, wherein the first and second inertial measurements correspond to one of: yaw, roll and pitch.

9. A method in accordance with claim 1, further comprising determining a plurality of antenna pointing controller calibration parameters based at least in part on a plurality of inertial measurements received from the first inertial measurement unit and the second inertial measurement unit, the plurality of inertial measurements including inertial measurements corresponding to each of: yaw, roll and pitch.

10. A method in accordance with claim 1, wherein the mount point is adapted to mount a steerable antenna subsystem.

11. A method in accordance with claim 10, wherein the steerable antenna subsystem is a subsystem of a satellite antenna.

12. A method in accordance with claim 1, wherein the mount point is physically distant from the first inertial measurement unit.

13. A method in accordance with claim 1, wherein the craft corresponds to at least one of: a watercraft, an aircraft and a spacecraft.

14. A method in accordance with claim 1, wherein inertial guidance of the craft is based at least in part on data received from the first inertial measurement unit.

15. An apparatus for antenna pointing controller calibration, comprising:

a first inertial measurement unit;

a power source that is electrically coupled with the first inertial measurement unit; and a first coupling that is connectively coupled with the first inertial measurement unit and that is adapted to a mechanical keying of a mount point of a craft such that inertial measurements with the first inertial measurement unit are applicable to an antenna subsystem incorporating a second coupling that is adapted to the mechanical keying of the mount point of the craft.

16. An apparatus in accordance with claim 15, wherein the mechanical keying determines a unique alignment of the apparatus when the apparatus is mounted with the mount point of the craft.

17. An apparatus in accordance with claim 16, wherein the mechanical keying determines an alignment of the antenna subsystem that corresponds to the unique alignment when the antenna subsystem is mounted with the mount point of the craft.

18. An apparatus in accordance with claim 15, wherein the first coupling comprises a rigid plate.

19. An apparatus in accordance with claim 15, further comprising a computing device communicatively coupled with the first inertial measurement unit and a second inertial measurement unit of the craft, the computing device configured to:

receive, from the first inertial measurement unit, a first inertial measurement;

receive, from the second inertial measurement unit, a second inertial measurement; and determine an antenna pointing controller calibration parameter based at least in part on the first inertial measurement and the second inertial measurement.

20. An apparatus in accordance with claim 19, wherein inertial guidance of the craft is based at least in part on data received from the second inertial measurement unit.

21. An apparatus in accordance with claim 19, wherein the computing device is further configured to configure an antenna pointing controller based at least in part on the antenna pointing controller calibration parameter.

22. An apparatus in accordance with claim 15, wherein the power source comprises a battery.

23. An apparatus in accordance with claim 15, wherein the mechanical keying comprises a keying feature arranged to determine a unique mounting alignment with respect to a plurality of mounting holes.

24. An apparatus in accordance with claim 23, wherein the keying feature corresponds to a chord of a circular mounting plate of the mount point.

25. An apparatus in accordance with claim 15, wherein the mount point is adapted to simultaneously mount the apparatus and the antenna subsystem.

26. A non-transitory computer-readable medium having thereon computer-executable instructions that, when executed by a computing device, cause the computing device to, at least:

receive, from a first inertial measurement unit of a craft, a first inertial measurement;

receive, from a second inertial measurement unit of a calibration unit mounted to a mount point of the craft, a second inertial measurement; and determine an antenna pointing controller calibration parameter based at least in part on the first inertial measurement and the second inertial measurement.

* * * * *

UNITED STATES PATENT AND TRADEMARK OFFICE

CERTIFICATE OF CORRECTION

PATENT NO. : 8,730,115 C1
APPLICATION NO. : 96/000088
DATED : September 3, 2015
INVENTOR(S) : Yeshanov et al.

It is certified that error appears in the above-identified patent and that said Letters Patent is hereby corrected as shown below:

ON THE TITLE PAGE

Bibliographic Data, Item (71) Applicants, delete "Alex Yeshanov, San Diego, CA (US); Donald Buchman, San Diego, CA (US); Ronald Tabor, San Diego, CA (US)" and insert --ViaSat, Inc., Carlsbad, CA (US)--

Bibliographic Data, Item (73) Assignee, delete "UNION BANK, N.A., Los Angeles, CA (US)" and insert --ViaSat, Inc., Carlsbad, CA (US)--

IN THE SPECIFICATION

Column 2, line 8-19, change from italicized text to normal text, as this is the original claim language, "configuring an antenna pointing controller with the antenna pointing controller calibration parameter;
optimizing a signal received at an antenna subsystem mounted with the mount point at least in part by moving the antenna subsystem with the antenna pointing controller;
determining a new value for the antenna pointing controller calibration parameter based at least in part on the optimizing; and
configuring the antenna pointing controller with the new value for the antenna pointing controller calibration parameter."

Signed and Sealed this
Seventeenth Day of May, 2016

Michelle K. Lee

Michelle K. Lee
*Director of the United States Patent and Trademark Office*

US008730115C1

(12) EX PARTE REEXAMINATION CERTIFICATE (36th)

Ex Parte Reexamination Ordered under 35 U.S.C. 257

United States Patent

Yeshanov et al.

(10) Number: US 8,730,115 C1

(45) Certificate Issued: Sep. 3, 2015

(54) SYSTEM AND METHOD FOR ANTENNA POINTING CONTROLLER CALIBRATION

(71) Applicants: Alex Yeshanov, San Diego, CA (US); Donald Buchman, San Diego, CA (US); Ronald Tabor, San Diego, CA (US)

(72) Inventors: Alex Yeshanov, San Diego, CA (US); Donald Buchman, San Diego, CA (US); Ronald Tabor, San Diego, CA (US)

(73) Assignee: UNION BANK, N.A., Los Angeles, CA (US)

Supplemental Examination Request:
No. 96/000,088, Jan. 12, 2015

Reexamination Certificate for:

| | |
|---|---|
| Patent No.: | **8,730,115** |
| Issued: | **May 20, 2014** |
| Appl. No.: | **13/993,060** |
| PCT Filed: | **Nov. 21, 2012** |
| PCT No.: | **PCT/US2012/066351** |
| § 371 (c)(1), | |
| (2) Date: | **Jun. 10, 2013** |
| PCT Pub. No.: | **WO2013/081940** |
| PCT Pub. Date: | **Jun. 6, 2013** |

Related U.S. Application Data

(60) Provisional application No. 61/564,781, filed on Nov. 29, 2011.

(51) Int. Cl.

| | |
|---|---|
| ***H01Q 3/00*** | (2006.01) |
| ***H01Q 1/28*** | (2006.01) |
| ***H01Q 1/32*** | (2006.01) |

(52) U.S. Cl.
CPC . *H01Q 3/00* (2013.01); *H01Q 1/28* (2013.01); *H01Q 1/32* (2013.01)

(58) Field of Classification Search
None
See application file for complete search history.

(56) References Cited

To view the complete listing of prior art documents cited during the supplemental examination proceeding and the resulting reexamination proceeding for Control Number 96/000,088, please refer to the USPTO's public Patent Application Information Retrieval (PAIR) system under the Display References tab.

*Primary Examiner* — Angela M Lie

(57) ABSTRACT

A craft (e.g., an aircraft, a spacecraft, a watercraft, a vehicle such as an automotive vehicle or a rail vehicle, or any suitable mobile platform) may incorporate a first inertial measurement unit. A calibration unit incorporating a second inertial measurement unit may be mounted to the craft with a mount point. One or more first inertial measurements may be received from the first inertial measurement unit and the second inertial measurement unit. One or more antenna pointing controller calibration parameters may be determined based at least in part on the first inertial measurement(s) and the second inertial measurement(s). An antenna pointing controller may be configured with the determined calibration parameters and may control a steerable antenna subsystem mounted with the mount point utilizing the determined calibration parameters. The mount point may be keyed such that inertial measurements with the mounted calibration unit are applicable to the mounted steerable antenna subsystem.

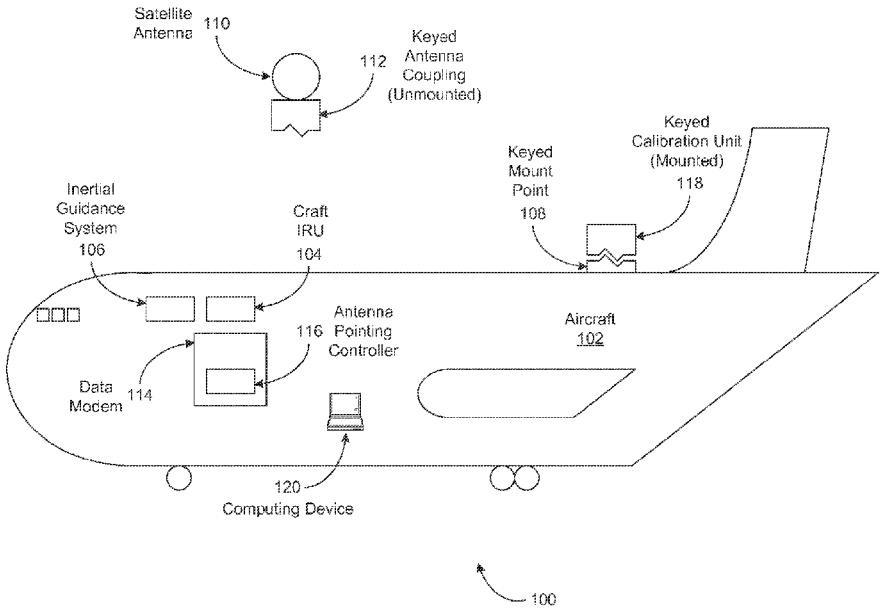

EX PARTE REEXAMINATION CERTIFICATE

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

Claims 2, 3 and 23 are cancelled.

Claims 1, 4, 5, 7, 11, 15 and 24-26 are determined to be patentable as amended.

Claims 6, 8-10, 12-14 and 16-22, dependent on an amended claim, are determined to be patentable.

1. A method for antenna pointing controller calibration, comprising:

mounting, with a mount point of a craft incorporating a first inertial measurement unit, a calibration unit incorporating a second inertial measurement unit, *wherein the mount point incorporates a mechanical keying, the calibration unit incorporates a first coupling adapted to the mechanical keying and an antenna subsystem incorporates a second coupling adapted to the mechanical keying, such that inertial measurements with the calibration unit are applicable to the antenna subsystem, and wherein the mechanical keying comprises a keying feature arranged to determine a unique mounting alignment with respect to a plurality of mounting holes;* receiving, from the first inertial measurement unit, a first inertial measurement;

receiving, from the second inertial measurement unit, a second inertial measurement; and determining an antenna pointing controller calibration parameter based at least in part on the first inertial measurement and the second inertial measurement.

4. A method [in accordance with claim 2,] *for antenna pointing controller calibration, comprising:*

*mounting, with a mount point of a craft incorporating a first inertial measurement unit, a calibration unit incorporating a second inertial measurement unit, wherein the mount point incorporates a mechanical keying, the calibration unit incorporates a first coupling adapted to the mechanical keying and an antenna subsystem incorporates a second coupling adapted to the mechanical keying, such that inertial measurements with the calibration unit are applicable to the antenna subsystem, and* wherein the mount point is adapted to simultaneously mount the calibration unit and the antenna subsystem;

*receiving, from the first inertial measurement unit, a first inertial measurement*;

*receiving, from the second inertial measurement unit, a second inertial measurement; and*

*determining an antenna pointing controller calibration parameter based at least in part on the first inertial measurement and the second inertial measurement.*

5. A method [in accordance with claim 1, further] *for antenna pointing controller calibration,* comprising:

*mounting, with a mount point of a craft incorporating a first inertial measurement unit, a calibration unit incorporating a second inertial measurement unit;*

*receiving, from the first inertial measurement unit, a first inertial measurement;*

*receiving, from the second inertial measurement unit, a second inertial measurement;*

*determining an antenna pointing controller calibration parameter based at least in part on the first inertial measurement and the second inertial measurement;*

*configuring an antenna pointing controller with the antenna pointing controller calibration parameter;*

*optimizing a signal received at an antenna subsystem mounted with the mount point at least in part by moving the antenna subsystem with the antenna pointing controller;*

*determining a new value for the antenna pointing controller calibration parameter based at least in part on the optimizing; and*

*configuring the antenna pointing controller with the new value for the antenna pointing controller calibration parameter.*

7. A method [in accordance with claim 6, further] *for antenna pointing controller calibration,* comprising:

*mounting, with a mount point of a craft incorporating a first inertial measurement unit, a calibration unit incorporating a second inertial measurement unit;*

*receiving, from the first inertial measurement unit, a first inertial measurement;*

*receiving, from the second inertial measurement unit, a second inertial measurement;*

*determining an antenna pointing controller calibration parameter based at least in part on the first inertial measurement and the second inertial measurement;*

*configuring an antenna pointing controller based at least in part on the antenna pointing controller calibration parameter;*

*dismounting the calibration unit from the mount point of the craft;*

*mounting a steerable antenna subsystem with the mount point of the craft;* receiving, from the first inertial measurement unit, a third inertial measurement;

transforming the third inertial measurement based at least in part on the antenna pointing controller calibration parameter; and pointing the steerable antenna subsystem based at least in part on the transformed third inertial measurement.

11. A method [in accordance with claim 10,] *for antenna pointing controller calibration, comprising:*

*mounting, with a mount point of a craft incorporating a first inertial measurement unit, a calibration unit incorporating a second inertial measurement unit, wherein the mount point is adapted to mount a steerable antenna subsystem, and* wherein the steerable antenna subsystem is a subsystem of a satellite antenna*;*

*receiving, from the first inertial measurement unit, a first inertial measurement;*

*receiving, from the second inertial measurement unit, a second inertial measurement; and*

*determining an antenna pointing controller calibration parameter based at least in part on the first inertial measurement and the second inertial measurement.*

15. An apparatus for antenna pointing controller calibration, comprising:

a first inertial measurement unit;

a power source that is electrically coupled with the first inertial measurement unit;

and a first coupling that is connectively coupled with the first inertial measurement unit and that is adapted to a mechanical keying of a mount point of a craft such that inertial measurements with the first inertial measurement unit are applicable to an antenna subsystem incorporating a second coupling that is adapted to the mechanical keying of the mount point of the craft, *wherein the mechanical keying comprises a keying feature arranged to determine a unique mounting alignment with respect to a plurality of mounting holes.*

24. An apparatus in accordance with claim [23] *15,* wherein the keying feature corresponds to a chord of a circular mounting plate of the mount point.

25. An apparatus [in accordance with claim 15] *for antenna pointing controller calibration, comprising:*

*a first inertial measurement unit;*

*a power source that is electrically coupled with the first inertial measurement unit; and*

*a first coupling that is connectively coupled with the first inertial measurement unit and that is adapted to a mechanical keying of a mount point of a craft such that inertial measurements with the first inertial measurement unit are applicable to an antenna subsystem incorporating a second coupling that is adapted to the mechanical keying of the mount point of the craft,* wherein the mount point is adapted to simultaneously mount the apparatus and the antenna subsystem.

26. A non-transitory computer-readable medium having thereon computer-executable instructions that, when executed by a computing device, cause the computing device to, at least:

receive, from a first inertial measurement unit of a craft, a first inertial measurement;

receive, from a second inertial measurement unit of a calibration unit mounted to a mount point of the craft, a second inertial measurement; [and]

determine an antenna pointing controller calibration parameter based at least in part on the first inertial measurement and the second inertial measurement*;*

*configure an antenna pointing controller with the antenna pointing controller calibration parameter;*

*optimize a signal received at an antenna subsystem mounted with the mount point at least in part by moving the antenna subsystem with the antenna pointing controller;*

*determine a new value for the antenna pointing controller calibration parameter based at least in part on the optimizing; and*

*configure the antenna pointing controller with the new value for the antenna pointing controller calibration parameter.*

* * * * *